US012378648B2

(12) United States Patent
Takeda et al.

(10) Patent No.: US 12,378,648 B2
(45) Date of Patent: Aug. 5, 2025

(54) ALLOY

(71) Applicant: NIPPON STEEL CORPORATION, Tokyo (JP)

(72) Inventors: Kiyoko Takeda, Tokyo (JP); Shunichi Otsuka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 491 days.

(21) Appl. No.: 17/755,689

(22) PCT Filed: Dec. 25, 2020

(86) PCT No.: PCT/JP2020/048927
§ 371 (c)(1),
(2) Date: May 5, 2022

(87) PCT Pub. No.: WO2021/132634
PCT Pub. Date: Jul. 1, 2021

(65) Prior Publication Data

US 2022/0380872 A1 Dec. 1, 2022

(30) Foreign Application Priority Data

Dec. 27, 2019 (JP) ..... 2019-238842

(51) Int. Cl.
*C22C 38/08* (2006.01)
*C22C 38/04* (2006.01)
(Continued)

(52) U.S. Cl.
CPC ..... *C22C 38/08* (2013.01); *C22C 38/04* (2013.01); *C22C 38/12* (2013.01); *C22C 38/14* (2013.01)

(58) Field of Classification Search
CPC ..... C22C 38/08; C22C 38/04; C22C 38/12; C22C 38/14; C22C 38/002; C22C 38/008;
(Continued)

(56) References Cited

U.S. PATENT DOCUMENTS

2017/0096727 A1 4/2017 Reydet et al.

FOREIGN PATENT DOCUMENTS

GB 2117399 A 10/1983
JP 6314842 A 1/1988
(Continued)

*Primary Examiner* — Danielle M. Carda
(74) *Attorney, Agent, or Firm* — Greer, Burns & Crain, Ltd.

(57) ABSTRACT

Provided is an alloy having a high strength and a low thermal expansion coefficient. The alloy according to the present disclosure includes a chemical composition containing, in mass %: C: 0.10% or less, Si: 0.50% or less, Mn: 0.15 to 0.60%, P: 0.015% or less, 5: 0.0030% or less, Ni: 30.0 to 40.0%, Cr: 0.50% or less, Mo: 0.50% or less, Co: 0.250% or less, Al: 0.0150% or less, Ca: 0.0050% or less, Mg: 0.0300% or less, N: 0.0100% or less, O: 0.0300% or less, Pb: 0.0040% or less, and Zn: 0.020% or less, one or more elements selected from the group consisting of Nb: 0 to less than 0.145%, Ti: 0 to less than 0.145%, and. V: 0 to less than 0.145%: 0.015 to less than 0.145% in total, with the balance being Fe and impurities, and satisfying Formula (1).

$$(Nb+3\times Ti+V)/(C+N)\leq 6.00 \quad (1)$$

4 Claims, 2 Drawing Sheets

(51) Int. Cl.
*C22C 38/12* (2006.01)
*C22C 38/14* (2006.01)

(58) Field of Classification Search
CPC ..... C22C 38/02; C22C 38/06; C22C 38/42; C22C 38/44; C22C 38/46; C22C 38/48; C22C 38/50; C22C 38/52; C22C 38/54; C22C 38/60; C22C 38/001; C21D 9/28; C21D 9/46; C21D 9/08; C21D 1/26; C21D 6/004; C21D 6/02; C21D 7/02; C21D 7/12; C21D 7/13; C21D 8/0205; C21D 8/0226; C21D 8/0236; C21D 8/0273; C21D 8/065; C21D 8/105
USPC ..... 420/94
See application file for complete search history.

(56) References Cited

FOREIGN PATENT DOCUMENTS

| | | | | | |
|---|---|---|---|---|---|
| JP | 05195160 | A | | 8/1993 | |
| JP | H05-195160 | A | * | 8/1993 | ..... C22C 38/00 |
| JP | 09263891 | A | | 10/1997 | |
| JP | 10017997 | A | | 1/1998 | |
| JP | 10140288 | A | | 5/1998 | |
| JP | 10195531 | | | 7/1998 | |
| JP | 2001-303200 | A | * | 10/2001 | ..... C22C 38/00 |
| JP | 2017512899 | A | | 5/2017 | |

* cited by examiner

ALLOY

TECHNICAL FIELD

The present disclosure relates to an alloy, more specifically to an alloy having a low thermal expansion coefficient.

BACKGROUND ART

As a material for a pipe for transmitting a low temperature material such as liquefied natural gas (LNG) or a tank for storing the low temperature material, an austenitic stainless steel material, which resists being embrittled even at a low temperature, is used.

In the pipe for transmitting a low temperature material or the tank for storing the low temperature material, a temperature of the pipe or the tank drops when the low temperature material flows through the pipe or when the low temperature material is stored in the tank, and the temperature rises when the low temperature material does not flow through the pipe or when the low temperature material is not stored in the tank. The above described austenitic stainless steel material has a high thermal expansion coefficient. Therefore, in the pipe for transmitting a low temperature material or the tank for storing the low temperature material, thermal expansion and thermal contraction occur with temperature changes. Hence, in a pipe for transmitting a low temperature material, loop piping is disposed every predetermined length, as a mechanism for absorbing such thermal expansion and thermal contraction. The loop piping absorbs deformation of the pipe for transmission by thermal expansion and thermal contraction. However, the loop piping increases a total length of the pipe, increasing a production cost. Thus, as a material for a pipe for transmitting a low temperature material or a tank for storing the low temperature material, there is a demand for an alloy having a lower thermal expansion coefficient than a thermal expansion coefficient of an austenitic stainless steel material.

As an alloy having a low thermal expansion coefficient, an Invar alloy is known. The Invar alloy exerts spontaneous volume magnetostriction (Invar effect) to keep a low thermal expansion coefficient against temperature changes. The Invar alloy thus resists being changed in its dimensions even under an influence of heat. A thermal expansion coefficient of an Invar alloy is much lower than a thermal expansion coefficient of austenitic stainless steel material. Therefore, when an Invar alloy is used as a material for a pipe for transmitting a low temperature material or a tank for storing the low temperature material, deformation of the pipe for transmission or the tank for storage due to thermal expansion and thermal contraction is suppressed.

An Invar alloy to be used for a pipe for transmitting a low temperature material represented by LNG or a tank for storing the low temperature material is disclosed in Japanese Translation of PCT International Application Publication No. 2017-512899 (Patent Literature 1).

An alloy disclosed in Patent Literature 1 contains 35 wt %≤Ni≤37 wt %, Mn≤0.6 wt %, C≤0.07 wt %, Si≤0.35 wt %, Cr≤0.5 wt %, Co≤0.5 wt %, P≤0.01 wt %, Mo<0.5 wt %, S≤0.0035 wt %, O≤0.0025 wt %, 0.011 wt %≤[(3.138×Al+6×Mg+13.418×Ca)−(3.509×O+1.770×S)]≤0.038 wt %, 0.0003 wt %<Ca≤0.0015 wt %, 0.0005 wt %<Mg≤0.0035 wt %, and 0.0020 wt %<Al≤0.0085 wt %, with the balance being Fe and residual elements produced by refining. Patent Literature 1 describes that the alloy disclosed in this literature is used for a tank or a pipe for receiving liquefied gas.

Although having a low thermal expansion coefficient, an Invar alloy has a low strength. If a strength of an alloy having a low thermal expansion coefficient is high, thinning of a wall of a pipe for transmission is enabled, thereby increasing structural stabilities of a pipe for transmission and a storage tank. There is thus a demand for an Invar alloy having a high strength.

Techniques for increasing a strength of an Invar alloy are disclosed in, for example, Japanese Patent Application Publication No. 10-017997 (Patent Literature 2) and Japanese Patent Application Publication No. 10-195531 (Patent Literature 3).

The Invar alloy disclosed in Patent Literature 2 contains, in weight proportion, C: 0.015 to 0.10%, Si: 0.35% or less, Mn: 1.0% or less, P: 0.015% or less, S: 0.0010% or less, Cr: 0.3% or less, Ni: 35 to 37%, Mo: 0 to 0.5%, V: 0 to 0.05%, Al: 0.01% or less, Nb: 0.15% or more to less than 1.0%, Ti: 0.003% or less, N: 0.005% or less, with the balance being Fe and unavoidable impurities. Patent Literature 2 describes that a high-strength Invar alloy excellent in hot workability is thereby provided.

The method for producing an Invar alloy disclosed in Patent Literature 3 is a method for producing an Fe—Ni Invar alloy containing, in weight percent, Ni: 30 to 45% and C: 0.001 to 0.04% in which the alloy is heated to 900 to 1150° C. and subjected to hot rolling at a temperature equal to or less than TR° C. expressed by Formula (1) shown below and with an accumulative rolling reduction of 5% or more. Patent Literature 3 describes that an Invar alloy excellent in strength and toughness is thereby provided.

$$T_R(^\circ\,\mathrm{C.})=2{,}500\times C\%+750 \quad (1)$$

CITATION LIST

Patent Literature

Patent Literature 1: Japanese Translation of PCT International Application Publication No. 2017-512899

Patent Literature 2: Japanese Patent Application Publication No. 10-017997

Patent Literature 3: Japanese Patent Application Publication No. 10-195531

SUMMARY OF INVENTION

Technical Problem

A strength of an Invar alloy can be increased by the techniques disclosed in Patent Literature 2 and Patent Literature 3. However, although the conventional techniques can increase a strength of an Invar alloy, a thermal expansion coefficient of the alloy increases in some cases. Hence, there is a demand for an alloy that has a sufficiently high strength as well as a sufficiently low thermal expansion coefficient.

An objective of the present disclosure is to an alloy that has a high strength and a low thermal expansion coefficient.

Solution to Problem

An alloy according to the present disclosure includes a chemical composition consisting of: in mass %, C: 0.10% or less, Si: 0.50% or less, Mn: 0.15 to 0.60%, P: 0.015% or less, S: 0.0030% or less, Ni: 30.0 to 40.0%,
Cr: 0.50% or less,
Mo: 0.50% or less,
Co: 0.250% or less,
Al: 0.0150% or less,
Ca: 0.0050% or less,
Mg: 0.0300% or less,
N: 0.0100% or less,
O: 0.0300% or less,
Pb: 0.0040% or less,
Zn: 0.020% or less,
a total of one or more elements selected from the group consisting of Nb: 0 to less than 0.145%, Ti: 0 to less than 0.145%, and V: 0 to less than 0.145%: 0.015 to less than 0.145%,
Cu: 0 to 0.300%,
Sn: 0 to 0.100%,
W: 0 to 0.200%, and
B: 0 to 0.0040%,
with the balance being Fe and impurities, and
satisfying Formula (1):

$$(Nb+3\times Ti+V)/(C+N)\leq 6.00 \quad (1)$$

where symbols of elements in Formula (I) are to be substituted by contents of the elements in the chemical composition of the alloy, in mass %.

Advantageous Effect of Invention

The alloy according to the present disclosure has a high strength and a low thermal expansion coefficient.

DESCRIPTION OF EMBODIMENT

Figure 1A:
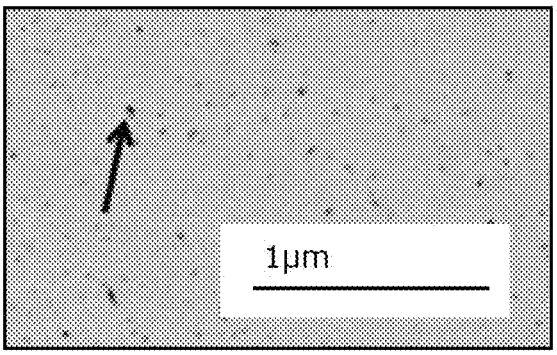
FIG. 1A is a transmission electron microscope (TEM) picture of an alloy of Test No. 4.

The present inventors conducted investigations and studies about an alloy having a high strength and providing a low thermal expansion coefficient.

It is known that when a content of Ni of a Ni—Fe based alloy is 30.0 to 40.0 mass %, a thermal expansion coefficient of the alloy is lowered by the Invar effect. Such a Ni—Fe based alloy is required to have a basic performance of a low thermal expansion coefficient as such. Accordingly, even in a case where increasing a strength of a Ni—Fe based alloy in which a content of Ni is 30.0 to 40.0 mass % is studied, it is required to increase strength while an increasing of the thermal expansion coefficient is suppressed.

One of methods for increasing a strength of an alloy is precipitation strengthening. In the precipitation strengthening, carbide, nitride, and/or carbo-nitride are caused to precipitate to strengthen the alloy. However, when precipitates such as the carbide and nitride are formed in the alloy, a thermal expansion coefficient of the alloy is increased due to thermal expansion of the precipitates. For a Ni—Fe based alloy in which a content of Ni is 30.0 to 40.0 mass %, increasing its strength with suppression of an increase in its thermal expansion coefficient has been studied, and thus increasing the strength by the precipitation strengthening has been avoided. Hence, in conventional practices, increasing a strength of an alloy by solid-solution strengthening, grain refinement of a grain size, or cold working, rather than the precipitation strengthening, has been attempted.

For example, according to Patent Literature 2 described above, the strength of its alloy is increased by making the alloy contain 0.15% or more of Nb as an alloying element (paragraphs [0012] and [0023] of Patent Literature 2). In Example of Patent Literature 2, a content of C in the alloy is kept low. Therefore, according to Patent Literature 2, a large amount of Nb is dissolved to increase the strength of the alloy by solid-solution strengthening. According to Patent Literature 3, by adjusting rolling conditions to adjust a residual strain of its alloy, thereby increasing the strength of the alloy (paragraph [0011] of Patent Literature 3). That is, according to Patent Literature 2 and Patent Literature 3, the strengths of their alloys are increased by the methods other than precipitation strengthening.

As described above, in a case where increasing the strength with suppression of an increase in the thermal expansion coefficient is intended, increasing the strength by precipitation strengthening has been avoided in conventional practices. Further, for the strengthening using Nb, a technique in which 0.15% or more of Nb is contained, and a content of C is decreased to prevent or reduce production of carbides, and Nb is dissolved to give rise to solid-solution strengthening is proposed. This technique is intended to avoid increasing a thermal expansion coefficient of an alloy due to thermal expansion of precipitates is attempted.

In a case where a strength of a Ni—Fe based alloy in which a content of Ni is 30.0 to 40.0 mass % is increased by using Nb. the increase is made by solid-solution strengthening with dissolved Nb rather than precipitation strengthening, as described above. However, as a result of studies made by the present inventors, a large amount of dissolved Nb can rather have an influence on the thermal expansion coefficient.

Figure 1B:
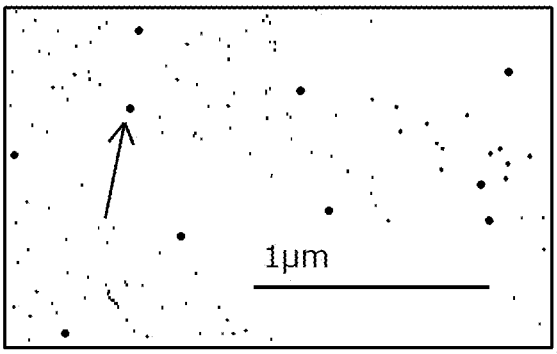
FIG. 1B is a schematic diagram of the TEM picture illustrated in FIG. 1A.

Hence, the present inventors conducted studies about an alloy that can achieve compatibility between a low thermal expansion coefficient and a high strength even with a reduced amount of dissolved Nb. FIG. 1A is a transmission electron microscope (TEM) picture of an alloy of Test No. 4 (inventive example of the present invention) in EXAMPLE to be described below. FIG. 1B is a schematic diagram of the TEM picture illustrated in FIG. 1A. Components of a black point portion indicated by arrows in FIG. 1 (FIG. 1A and FIG. 1B) were analyzed, and it was found that the black point portion was a precipitate containing 86.3% of Nb in a composition excluding C. That is, the black point in the TEM picture of FIG. 1 is a precipitate (carbonitride) containing Nb. As illustrated in the TEM picture of FIG. 1, nanosized, fine carbo-nitrides precipitate in the alloy of Test No. 4. According to conventional studies, carbonitrides increase a thermal expansion coefficient of an alloy. However, contrary to expectations, a thermal expansion coefficient of the alloy of Test No. 4 was low, as will be described in EXAMPLE below.

The present inventors studied this result in detail, obtaining a finding different from the conventional finding. The present inventors considered that it is possible to obtain a lower thermal expansion coefficient while increasing the strength by causing nanosized fine carbo-nitrides (hereinafter, simply referred to as nano-carbo-nitrides). The nano-carbo-nitrides pin dislocations. Alloys thereby can be strengthened. In addition, by virtue of their very small volumes, expansion of volumes of the nano-carbo-nitrides with respect to a change in temperature is small. The present inventors therefore considered that a strength of a Ni—Fe based alloy can be increased not by solid-solution strengthening with dissolved Nb but by precipitation strengthening with nano-carbo-nitrides. It is considered that the amount of the dissolved Nb thereby can be reduced, and the thermal expansion coefficient can be further decreased. Note that "carbo-nitride" herein includes carbide, nitride, and/or carbo-nitride.

The present inventors conducted studies for specifying a size and a number density of nano-carbo-nitrides with which the alloy can achieve compatibility between a low thermal expansion coefficient and a high strength. However, as illustrated in FIG. 1, the nano-carbo-nitrides are very small and thus difficult to specify, their appropriate size and their appropriate number density accurately. Hence, the present inventors conducted studies about a chemical composition of a Ni—Fe based alloy with which such nano-carbo-nitrides can be finely dispersed. The present inventors considered that nano-carbo-nitrides may be caused to precipitate with a chemical composition that contains one or more of Nb, Ti, and V, which form their carbo-nitrides, and has increased content of C and content of N. Specifically, it is considered that when an alloy containing, in mass %: C: 0.10% or less, Si: 0.50% or less, Mn: 0.15 to 0.60%, P: 0.015% or less, S: 0.0030% or less, Ni: 30.0 to 40.0%, Cr: 0.50% or less, Mo: 0.50% or less, Co: 0.250% or less, Al: 0.0150% or less, Ca: 0.0050 or less, Mg: 0.0300% or less, N: 0.0100% or less, O: 0.0300% or less, Pb: 0.0040% or less, Zn: 0.020% or less, Cu: 0 to 0.300%, Sn: 0 to 0.100%, W: 0 to 0.200%, and B: 0 to 0.0040% with the balance being Fe and impurities contains, in lieu of part of the Fe, one or more elements selected from the group consisting of Nb: 0 to less than 0.145%, Ti: 0 to less than 0.145%, and V: 0 to less than 0.145% at a content of 0.015 to less than 0.145% in total, there is a possibility that nano-carbo-nitrides can be caused to precipitate, and consequently a thermal expansion coefficient of the alloy may be further decreased while its strength is increased.

However, although succeeding in increasing its strength, the alloy only having the above chemical composition failed to decrease its thermal expansion coefficient. The present inventors investigated the cause in detail. As a result, it was found that only having the above chemical composition may result in excessive precipitation of carbo-nitrides. The present inventors thus conducted further studies about an alloy that causes nano-carbo-nitrides to precipitate in an appropriate amount. As a result, the following finding was obtained.

Figure 2:
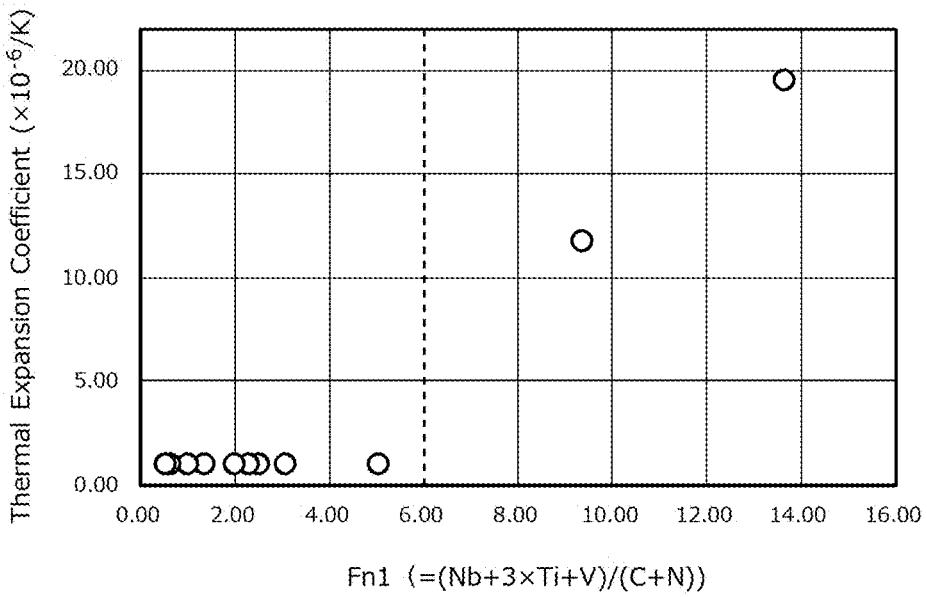
FIG. 2 is a graph illustrating a relation between Formula (1) and thermal expansion coefficient.

FIG. 2 is a graph illustrating a relation between Formula (I) and thermal expansion coefficient. FIG. 2 illustrates a relation between Formula (1) and thermal expansion coefficients for alloys in EXAMPLE to be described below that have chemical compositions in which contents of elements are within their respective ranges described above. The abscissa of FIG. 2 indicates the value of Fn1=(Nb+3×Ti+V)/(C+N). Here, symbols of elements are to be substituted by contents of the elements in the chemical composition of the alloy, in mass %. The ordinate of FIG. 2 indicates the thermal expansion coefficient of the alloy. The thermal expansion coefficient of the alloy was measured by the measurement method to be described below.

Referring to FIG. 2, if Fn1 is 6.00 or less, the thermal expansion coefficient of the alloy is significantly decreased. Formula (1) is an expression that defines a relation between a content of Nb, Ti, and V, which form nano-carbo-nitrides, and a content of C and N. When the total content of Nb, Ti, and V is limited to less than 0.145% and when Fn1 is 6.00 or less, excessive precipitation of nano-carbo-nitrides can be suppressed while nano-carbo-nitrides are finely dispersed. It is thereby possible to further decrease the thermal expansion coefficient of the alloy while increasing its strength.

The above is summarized as follows. An alloy is made to contain one or more elements selected from the group consisting of Nb: 0 to less than 0.145%, Ti: 0 to less than 0.145%, and V: 0 to less than 0.145%, at a content of 0.015% or more in total. Nano-carbo-nitrides of Nb, Ti, and/or V are thereby dispersed. The nano-carbo-nitrides pin dislocations. A strength of the alloy is thereby increased. At the same time, a total amount of the one or more elements selected from the group consisting of Nb: 0 to less than 0.145%, Ti: 0 to less than 0.145%, and V: 0 to less than 0.145% is limited to 0.015 to less than 0.145%. Further, a content of Nb, a content of Ti, and a content of V, and a content of C and a content of N are adjusted to satisfy Formula (1). This suppresses excessive precipitation of nano-carbo-nitrides of Nb, Ti, and/or V. Since volumes of the nano-carbo-nitrides of Nb, Ti, and/or V are very small, even when the nano-carbo-nitrides thermally expand, a change in their volumes is extremely small. It is therefore possible to obtain a high strength while keeping the thermal expansion coefficient of the alloy low. Note that Formula (1) is shown below.

$$(Nb+3\times Ti+V)/(C+N)\leq 6.00 \quad (1)$$

where symbols of elements in Formula (1) are to be substituted by contents of the elements in the chemical composition of the alloy, in mass %.

As described above, the alloy according to the present embodiment is made based on a concept that is totally different from conventional techniques. The alloy according to the present embodiment has the following configuration.

[1]

An alloy including a chemical composition consisting of: in mass %,

C: 0.10% or less,

Si: 0.50% or less,

Mn: 0.15 to 0.60%,

P: 0.015% or less,

S: 0.0030% or less,

Ni: 30.0 to 40.0%,

Cr: 0.50% or less,

Mo: 0.50% or less,

Co: 0.250% or less,

Al: 0.0150% or less,

Ca: 0.0050% or less,

Mg: 0.0300% or less,

N: 0.0100% or less,

O: 0.0300% or less,

Pb: 0.0040% or less,

Zn: 0.020% or less, a total of one or more elements selected from the group consisting of Nb: 0 to less than 0.145%, Ti: 0 to less than 0.145%, and V: 0 to less than 0.145%: 0.015 to less than 0.145%, Cu: 0 to 0.300%, Sn: 0 to 0.100%, W: 0 to 0.200%, and B: 0 to 0.0040%, with the balance being Fe and impurities, and satisfying Formula (1):

(Nb+3×Ti ±V)/(C+N) 6.00 (1)

where symbols of elements in Formula (1) are to be substituted by contents of the elements in the chemical composition of the alloy, in mass %.

The alloy according to [1] has a high strength and further has a low thermal expansion coefficient.

[2]

The alloy according to [1], wherein the chemical composition contains one or more elements selected from the group consisting of Cu: 0 to 0.300%, Sn: 0 to 0.100%, and W: 0 to 0.200% at 0.020% or more in total.

The alloy according to [2] has a high strength and a low thermal expansion coefficient and further has an excellent corrosion resistance.

[3]

The alloy according to [1] or [2], wherein the alloy is any one of a tube material, a sheet material, and a bar material.

The alloy according to the present embodiment will be described below in detail. Hereinafter, the symbol "%" in the chemical composition means mass % unless otherwise noted.

[Chemical Composition]

The chemical composition of the alloy according to the present embodiment contains the following elements.

C: 0.10% or less

Carbon (C) is contained unavoidably. That is, a content of C is more than 0%. In a steelmaking process, C deoxidizes the alloy. In addition, C increases a strength of the alloy. Even a trace amount of C contained produces the effects to some extent. However, if the content of C is more than 0.10%, even when contents of the other elements fall within their respective ranges according to the present embodiment, corrosion resistance of the alloy is decreased. The content of C is therefore 0.10% or less. An upper limit of the content of C is preferably 0.09%, more preferably 0.08%, still more preferably 0.06%, and even still more preferably 0.05%. A lower limit of the content of C is preferably 0.01%, and more preferably 0.02%.

Si: 0.50% or less

Silicon (Si) is unavoidably contained. That is, a content of Si is more than 0%. In a steelmaking process, Si deoxidizes the alloy. Even a trace amount of Si contained produces the effect to some extent. However, if the content of Si is more than 0.50%, even when contents of the other elements fall within their respective ranges according to the present embodiment, spontaneous volume magnetostriction of the alloy is decreased, and a thermal expansion coefficient of the alloy is increased. Further, if the content of Si is more than 0.50%, hot workability of the alloy is decreased. Moreover, if the content of Si is more than 0.50%, inclusions are produced in an excessively large amount, resulting in a decrease in corrosion resistance of the alloy. The content of Si is therefore 0.50% or less. An upper limit of the content of Si is preferably 0.40%, more preferably 0.30%, still more preferably 0.25%, and even still more preferably 0.20%. A lower limit of the content of Si is preferably 0.01%, more preferably 0.05%.

Mn: 0.15 to 0.60%

In a steelmaking process, manganese (Mn) deoxidizes the alloy. In addition, Mn combines with sulfur (5) to form MnS, increasing hot workability of the alloy. If a content of Mn is less than 0.15%, even when contents of the other elements fall within their respective ranges according to the present embodiment, the effects cannot be obtained sufficiently. On the other hand, if the content of Mn is more than 0.60%, even when contents of the other elements fall within their respective ranges according to the present embodiment, spontaneous volume magnetostriction of the alloy is decreased. As a result, a thermal expansion coefficient of the alloy is increased. The content of Mn is therefore 0.15 to 0.60%. A lower limit of the content of Mn is preferably 0.16%, more preferably 0.17%, still more preferably 0.19%, even still more preferably 0.20%, and even still more preferably 0.21%. An upper limit of the content of Mn is preferably 0.55%, more preferably 0.50%, and still more preferably 0.45%.

P: 0.015% or less

Phosphorus (P) is an impurity that is contained unavoidably. That is, a content of P is more than 0%. P decreases weldability and hot workability of the alloy. If the content of P is more than 0.015%, even when contents of the other elements fall within their respective ranges according to the present embodiment, weldability and hot workability of the alloy are significantly decreased. The content of P is therefore 0.015% or less. An upper limit of the content of P is preferably 0.012%, more preferably 0.010%, and still more preferably 0.008%. The content of P is preferably as low as possible. However, excessive reduction of the content of P increases a production cost. Therefore, with consideration given to industrial production, a lower limit of the content of P is preferably 0.001%, and more preferably 0.002%.

S: 0.0030% or less

Sulfur (S) is an impurity that is contained unavoidably. That is, a content of S is more than 0%. S decreases weldability and hot workability of the alloy. If the content of S is more than 0.0030%, even when contents of the other elements fall within their respective ranges according to the present embodiment, weldability and hot workability of the alloy are significantly decreased. The content of S is therefore 0.0030% or less. An upper limit of the content of S is preferably 0.0025%, more preferably 0.0020%, still more preferably 0.0015%, and even still more preferably 0.0010%. The content of S is preferably as low as possible. However, excessive reduction of the content of S increases a production cost. Therefore, with consideration given to industrial production, a lower limit of the content of S is preferably 0.0001%, and more preferably 0.0002%.

Ni: 30.0 to 40.0%

Nickel (Ni) increases spontaneous volume magnetostriction of the alloy and consequently decreases a thermal expansion coefficient of the alloy. In addition, Ni increases corrosion resistance of the alloy. If a content of Ni is less than 30.0%, even when contents of the other elements fall within their respective ranges according to the present embodiment, the effects cannot be obtained sufficiently. On the other hand, if the content of Ni is more than 40.0%, even when contents of the other elements fall within their respective ranges according to the present embodiment, a thermal expansion coefficient of the alloy is rather increased. The content of Ni is therefore 30.0 to 40.0%. A lower limit of the content of Ni is preferably 31.0%, more preferably 32.0%, still more preferably 33.0%, and even still more preferably 34.0%. An upper limit of the content of Ni is preferably 39.0%, more preferably 38.0%, and still more preferably 37.0%.

Cr: 0.50% or less

Chromium (Cr) is contained unavoidably. That is, a content of Cr is more than 0%. Cr increases corrosion resistance of the alloy. Even a trace amount of Cr contained produces the effect to some extent. However, if the content of Cr is more than 0.50%, even when contents of the other elements fall within their respective ranges according to the present embodiment, hot workability of the alloy is decreased. The content of Cr is therefore 0.50% or less. An upper limit of the content of Cr is preferably 0.45%, more preferably 0.40%, still more preferably 0.35%, even still more preferably 0.30%, even still more preferably 0.25%, even still more preferably 0.20%, even still more preferably 0.15%, and even still more preferably 0.10%. A lower limit of the content of Cr is preferably 0.01%.

Mo: 0.50% or less

Molybdenum (Mo) is contained unavoidably. That is, a content of Mo is more than 0%. Mo increases a strength of the alloy. Even a trace amount of Mo contained produces the effect to some extent. However, if the content of Mo is more than 0.50%, even when contents of the other elements fall within their respective ranges according to the present embodiment, hot workability of the alloy is decreased. The content of Mo is therefore 0.50% or less. An upper limit of the content of Mo is preferably 0.45%, more preferably 0.40%, still more preferably 0.35%, even still more preferably 0.30%, even still more preferably 0.25%, even still more preferably 0.20%, even still more preferably 0.15%, and even still more preferably 0.10%. A lower limit of the content of Mo is preferably 0.01%.

Co: 0.250% or less

Cobalt (Co) is contained unavoidably. That is, a content of Co is more than 0%. As with Ni, Co increases a strength of the alloy. Even a trace amount of Co contained produces the effect to some extent. However, if the content of Co is more than 0.250%, even when contents of the other elements fall within their respective ranges according to the present embodiment, a thermal expansion coefficient of the alloy is rather increased. The content of Co is therefore 0.250% or less. An upper limit of the content of Co is preferably 0.200%, more preferably 0.150%, still more preferably 0.100%, and even still more preferably 0.080%. A lower limit of the content of Co is preferably 0.001%, more preferably 0.005%, still more preferably 0.010%, and even still more preferably 0.020%.

Al: 0.0150% or less

Aluminum (Al) is contained unavoidably. That is, a content of Al is more than 0%. Al deoxidizes the alloy. Even a trace amount of Al contained produces the effect to some extent. However, if the content of Al is more than 0.0150%, even when contents of the other elements fall within their respective ranges according to the present embodiment, spontaneous volume magnetostriction of the alloy is decreased. As a result, a thermal expansion coefficient of the alloy is increased. The content of Al is therefore 0.0150% or less. An upper limit of the content of Al is preferably 0.0120%, more preferably 0.0100%, still more preferably 0.0090%, even still more preferably 0.0080%, even still more preferably 0.0070%, even still more preferably 0.0060%, and even still more preferably less than 0.0035%. A lower limit of the content of Al is preferably 0.0001%, more preferably 0.0005%, still more preferably 0.0010%, and even still more preferably 0.0012%. In the present embodiment, the content of Al is a content of total Al (Total-Al).

Ca: 0.0050% or less

Calcium (Ca) is contained unavoidably. That is, a content of Ca is more than 0%. Ca refines MnS, increasing hot workability of the alloy. Even a trace amount of Ca contained produces the effect to some extent. However, if the content of Ca is more than 0.0050%, even when contents of the other elements fall within their respective ranges according to the present embodiment, coarse inclusions are produced in an excessively large amount, resulting in a decrease in hot workability of the alloy. The content of Ca is therefore 0.0050% or less. An upper limit of the content of Ca is preferably 0.0040%, more preferably 0.0030%, and still more preferably 0.0020%. A lower limit of the content of Ca is preferably 0.0001%, more preferably 0.0003%, and still more preferably 0.0005%.

Mg: 0.0300% or less

Magnesium (Mg) is contained unavoidably. That is, a content of Mg is more than 0%. As with Ca, Mg refines VMS, increasing hot workability of the alloy. Even a trace amount of Mg contained produces the effect to some extent. However, if the content of Mg is more than 0.0300%, even when contents of the other elements fall within their respective ranges according to the present embodiment, coarse inclusions are produced in an excessively large amount, resulting in a decrease in hot workability of the alloy. The content of Mg is therefore 0.0300% or less. An upper limit of the content of Mg is preferably 0.0200%, more preferably 0.0100%, still more preferably 0.0050%, even still more preferably 0.0020%, and even still more preferably 0.0010%. A lower limit of the content of Mg is preferably 0.0001%, and more preferably 0.0002%.

N: 0.0100% or less

Nitrogen (N) is an impurity that is contained unavoidably. That is, a content of N is more than 0%. N decreases hot workability of an alloy. If the content of N is more than 0.0100%, even when contents of the other elements fall within their respective ranges according to the present embodiment, nitrides are produced in an excessively large amount, resulting in an increase in a thermal expansion coefficient of the alloy and in a decrease in corrosion resistance of the alloy. The content of N is therefore 0.0100% or less. An upper limit of the content of N is preferably 0.0095%, and more preferably 0.0090%. The content of N is preferably as low as possible. However, excessive reduction of N increases a production cost. Therefore, with consideration given to industrial production, a lower limit of the content of N is preferably 0.0001%, more preferably 0.0003%, and still more preferably 0.0005%.

O: 0.0300% or less

Oxygen (0) is an impurity that is contained unavoidably. That is, a content of 0 is more than 0%. 0 produces coarse inclusions, decreasing hot workability of the alloy. If the content of 0 is more than 0.0300%, even when contents of the other elements fall within their respective ranges according to the present embodiment, hot workability of the alloy is significantly decreased. The content of O is therefore 0.0300% or less. An upper limit of the content of O is preferably 0.0200%, more preferably 0.0180%, and still more preferably 0.0150%. The content of O is preferably as low as possible. However, excessive reduction of the content of O increases a production cost. Therefore, with consideration given to industrial production, a lower limit of the content of O is preferably 0.0001%, and more preferably 0.0005%.

Pb: 0.0040% or less

Lead (Pb) is an impurity that is contained unavoidably. That is, a content of Pb is more than 0%. Pb is a metal having a low fusing point and thus decreases hot workability of the alloy. If the content of Pb is more than 0.0040%, even when contents of the other elements fall within their respective ranges according to the present embodiment, hot workability of the alloy is significantly decreased. The content of Pb is therefore 0.0040% or less. An upper limit of the content of Pb is preferably 0.0030%, more preferably 0.0025%, still more preferably 0.0020%, even still more preferably 0.0015%, and even still more preferably 0.0010%. The content of Pb is preferably as low as possible. However, excessive reduction of the content of Pb increases a production cost. Therefore, with consideration given to industrial production, a lower limit of the content of Pb is preferably 0.0001%.

Zn: 0.020% or less

Zinc (Zn) is an impurity that is contained unavoidably. That is, a content of Zn is more than 0%. Zn is a metal having a low fusing point and thus decreases hot workability of the alloy. If the content of Zn is more than 0.020%, even when contents of the other elements fall within their respective ranges according to the present embodiment, hot workability of the alloy is significantly decreased. The content of Zn is therefore 0.020% or less. An upper limit of the content of Zn is preferably 0.018%, more preferably 0.016%, still more preferably 0.015%, and even still more preferably 0.010%. The content of Zn is preferably as low as possible. However, excessive reduction of the content of Zn increases a production cost. Therefore, with consideration given to industrial production, a lower limit of the content of Zn is preferably 0.001%.

Total of one or more elements selected from the group consisting of Nb: 0 to less than 0.145%, Ti: 0 to less than 0.145%, and V: 0 to less than 0.145%: 0.015 to less than 0.145%

Niobium (Nb), titanium (Ti), and vanadium (V) all increase a strength of the alloy. In a case where contents of elements in a chemical composition of an alloy fall within their respective ranges described above and satisfy Formula (1) to be described below, Nb, Ti, and V all form their nanoscale carbo-nitrides, which are dispersed and precipitate finely, increasing a strength of the alloy. If a total content of one or more elements selected from the group consisting of Nb: 0 to less than 0.145%, Ti: 0 to less than 0.145%, and V: 0 to less than 0.145% is less than 0.015%, even when contents of the other elements fall within their respective ranges according to the present embodiment, the effect cannot be obtained sufficiently. On the other hand, If the total content of one or more elements selected from the group consisting of Nb: 0 to less than 0.145%, Ti: 0 to less than 0.145%, and V: 0 to less than 0.145% is 0.145% or more, even when contents of the other elements fall within their respective ranges according to the present embodiment, the nanoscale carbo-nitrides are produced to excess. In this case, a thermal expansion coefficient of the alloy is increased, and corrosion resistance of the alloy is decreased. Therefore, the total content of one or more elements selected from the group consisting of Nb: 0 to less than 0.145%, Ti: 0 to less than 0.145%, and V: 0 to less than 0.145% is 0.015 to less than 0.145%. A lower limit of the total content of Nb, Ti, and V is preferably 0.016%, more preferably 0.017%, still more preferably 0.020%, and even still more preferably 0.030%. An upper limit of the total content of Nb, Ti, and V is preferably 0.140%, more preferably 0.135%, and still more preferably 0.120%.

The balance of the chemical composition of the alloy according to the present embodiment is Fe and impurities. The impurities herein mean those that are mixed in the alloy from ores and scraps as raw materials or from a production environment, etc. when the alloy is industrially produced and that are allowed to be in the alloy within their respective ranges in which the impurities have no adverse effect on the alloy according to the present embodiment.

[Optional Elements]

[Optional Elements of First Group (Cu, Sn, W)]

The chemical composition of the low thermal expansion alloy according to the present embodiment may further contain, in lieu of a part of Fe, one or more elements selected from the group consisting of Cu, Sn, and W. These elements all increase corrosion resistance of the alloy.

Cu: 0 to 0.300%

Copper (Cu) is an optional element and need not be contained. That is, a content of Cu may be 0%. When Cu is contained, that is, when the content of Cu is more than 0%, Cu increases corrosion resistance of the alloy. Even a trace amount of Cu contained produces the effect to some extent. However, if the content of Cu is more than 0.300%, even when contents of the other elements fall within their respective ranges according to the present embodiment, hot workability of the alloy is decreased. The content of Cu is therefore 0 to 0.300%. A lower limit of the content of Cu is preferably 0.001%, more preferably 0.005%, and still more preferably 0.010%. An upper limit of the content of Cu is preferably 0.250%, more preferably 0.200%, still more preferably 0.150%, even still more preferably 0.120%, even still more preferably 0.100%, and even still more preferably 0.070%.

Sn: 0 to 0.100%

Tin (Sn) is an optional element and need not be contained. That is, a content of Sn may be 0%. When Sn is contained, that is, when the content of Sn is more than 0%, Sn increases corrosion resistance of the alloy. Even a trace amount of Sn contained produces the effect to some extent. However, if the content of Sn is more than 0.100%, even when contents of the other elements fall within their respective ranges according to the present embodiment, hot workability of the alloy is decreased. The content of Sn is therefore 0 to 0.100%. A lower limit of the content of Sn is preferably 0.001%, more preferably 0.002%, and still more preferably 0.003%. An upper limit of the content of Sn is preferably 0.080%, more preferably 0.070%, still more preferably 0.050%, even still more preferably 0.030%, and even still more preferably 0.020%.

W: 0 to 0.200%

Tungsten (W) is an optional element and need not be contained. That is, a content of W may be 0%. When W is contained, that is, When the content of W is more than 0%, W increases corrosion resistance of the alloy. Even a trace amount of W contained produces the effect to some extent. However, if the content of W is more than 0.200%, even when contents of the other elements fall within their respective ranges according to the present embodiment, hot workability of the alloy is decreased. The content of W is therefore 0 to 0.200%. A lower limit of the content of W is preferably 0.001%, more preferably 0.003%, and still more preferably 0.005%. An upper limit of the content of W is preferably 0.150%, more preferably 0.100%, still more preferably 0.050%, even still more preferably 0.030%, and even still more preferably 0.020%.

[Preferable Total Content of Cu, Sn, and W]

In the chemical composition of the alloy according to the present embodiment, it is preferable that 0.020% or more of one or more elements selected from the group consisting of Cu: 0 to 0.300%, Sn: 0 to 0.100%, and W: 0 to 0.200% be contained in total.

Cu, Sn, and W all increase corrosion resistance of the alloy. If a total content of the one or more elements selected from the group consisting of Cu: 0 to 0.300%, Sn: 0 to 0.100%, and W: 0 to 0.200% is 0.020% or more, the corrosion resistance of the alloy is significantly increased. A lower limit of the total content of Cu, Sn, and W is preferably 0.025%, more preferably 0.030%, and still more preferably 0.040%. An upper limit of the total content of Cu, Sn, and W is preferably 0.600, more preferably 0.300%, still more preferably 0.250%, even still more preferably 0.200%, and even still more preferably 0.180%.

[Optional Element of Second Group (B)]

The chemical composition of the low thermal expansion alloy according to the present embodiment may further contain, in lieu of a part of Fe, B.

B: 0 to 0.0040%

Boron (B) is an optional element and need not be contained. That is, a content of B may be 0%. When B is contained, that is, when the content of B is more than 0%, B increases hot workability of the alloy. Even a trace amount of B contained produces the effect to some extent. However, if the content of B is more than 0.0040%, even when contents of the other elements fall within their respective ranges according to the present embodiment, the hot workability of the alloy is rather decreased. The content of B is therefore 0 to 0.0040%. A lower limit of the content of B is preferably 0.0001%, more preferably 0.0002%, still more preferably 0.0008%, and even still more preferably 0.0012%. An upper limit of the content of B is preferably 0.0035%, and more preferably 0.0030.

[Formula (1)]

The chemical composition of the alloy according to the present embodiment satisfies Formula (1).

$$(Nb+3\times Ti+V)/(C+N)\leq 6.00 \quad (1)$$

where symbols of elements in Formula (1) are to be substituted by contents of the elements in the chemical composition of the alloy, in mass %.

Let Fn1 be defined as Fn1=(Nb+3×Ti+V)/(C+N). In the alloy according to the present embodiment, on the precondition that the chemical composition satisfies the contents of the elements described above and that the total content of Nb, Ti, and V is 0.015 to less than 0.145%, when Fn1 is 6.00 or less, the nano-carbo-nitrides are finely dispersed in an appropriate amount in the alloy. As a result, it is possible to obtain a high strength and to keep the thermal expansion coefficient low. On the other hand, even if the chemical composition satisfies the contents of the elements described above and even if the total content of Nb, Ti, and V is 0.015 to less than 0.145%, when Fn1 is more than 6.00, the nano-carbo-nitrides precipitate in an excessively large amount. In this case, even though the strength of the alloy can be increased, the thermal expansion coefficient of the alloy is increased. Fn1 is therefore 6.00 or less. An upper limit of Fn1 is preferably 5.20, more preferably 4.20, and still more preferably 3.20. A lower limit of Fn1 is not particularly limited, but the lower limit is 0.13, for example.

[Shape of Alloy]

A shape of the alloy according to the present embodiment is not limited to a particular shape. The shape of the alloy is, for example, a tube material, a sheet material, and a bar material. The alloy is used as a starting material of a pipe for transmitting a low temperature material typified by LNG and a starting material of a tank for storing the low temperature material. Specifically, an alloy pipe, an alloy sheet, and an alloy bar are used as a material to be incorporated into a pipe for transmitting the low temperature material and a material to be incorporated into a tank for storing the low temperature material, by welding, etc.

In the alloy according to the present embodiment having the configuration described above, the contents of the elements in its chemical composition fall within their respective ranges described above, the total content of the one or more elements selected from the group consisting of Nb, Ti, and V is 0.015 to less than 0.145%, and the chemical composition satisfies Formula (1). The alloy according to the present embodiment therefore can achieve compatibility between a sufficiently low thermal expansion coefficient and a high strength. Further, in the alloy according to the present embodiment, the total content of the one or more elements selected from the group consisting of Cu, Sn, and W is preferably 0.020% or more. In this case, the alloy according to the present embodiment has a low thermal expansion coefficient and a high strength, as well as an excellent corrosion resistance.

[Producing Method]

An example of a producing method for the alloy according to the present embodiment will be described below. Note that the producing method for the alloy according to the present embodiment is not limited to the producing method described below. The producing method described below is a preferable example of the producing method for the alloy according to the present embodiment.

The producing method for the alloy according to the present embodiment includes, as an example, a starting material preparation step, a hot working step, a cold working step performed when necessary (i.e., an optional step), and a heat treatment step performed when necessary (i.e., an optional step). Each of the steps will be described below.

[Starting Material Preparation Step]

In the starting material preparation step, a starting material having the chemical composition described above is prepared. The starting material may be supplied from a third party or may be produced. The starting material may be an ingot or may be a slab, a bloom, or a billet. When the starting material is produced, the starting material is produced by the following method. A molten alloy having the chemical composition described above is produced. The produced molten alloy is used to produce an ingot by the ingot-making process. The produced molten alloy may be used to produce a slab, a bloom, or a billet (cylindrical starting material) by the continuous casting process. The produced ingot, slab, or bloom may be subjected to hot working to be produced into a billet. For example, the ingot may be subjected to hot forging to be produced into a column-shaped billet, and this billet may be used as the starting material (cylindrical starting material). In this case, a temperature of the starting material immediately before the hot forging is started is not limited to a particular temperature but is, for example, 900 to 1300° C. A method for cooling the starting material after the hot forging is not limited to a particular method.

[Hot Working Step]

In the hot working step, hot working is performed on the starting material prepared in the starting material preparation step to produce an intermediate material. The intermediate material may be a tube material, a sheet material, or a bar material.

In a case where the intermediate material is a tube material (alloy pipe), the following work is performed in the hot working step. First, a cylindrical starting material is prepared. Machine work is performed to form a through hole along a central axis of the cylindrical starting material. The cylindrical starting material in which the through hole is formed is subjected to hot extrusion represented by the Ugine-Sejoumet process to be produced into an intermediate material (alloy pipe). A temperature of the starting material immediately before the hot extrusion is not limited to a particular temperature. The temperature of the starting material immediately before the hot extrusion is, for example, 900 to 1300° C. In place of the hot extrusion process, a hot hollow forging process may be performed.

In place of the hot extrusion, piercing-rolling by the Mannesmann process may be performed to produce the alloy pipe. In this case, the cylindrical starting material is subjected to the piercing-rolling with a piercing machine.

The round billet subjected to the piercing-rolling is further subjected to hot rolling by a mandrel mill, a reducer, a sizing mill, or the like, to be produced into the intermediate material (alloy pipe). A cumulative reduction of area in the hot working step is not limited to a particular reduction of area but is, for example, 20 to 80%.

In a case where the intermediate material is a sheet material (alloy sheet), for example, one or more rolling mills each including a pair work rolls are used in the hot working step. Hot rolling using the rolling mills is performed on the starting material such as a slab to produce the alloy sheet. A temperature of the starting material immediately before the hot rolling is, for example, 800 to 1300° C.

In a case where the intermediate material is a bar material, the hot working step includes, for example, a rough rolling step and a finish rolling step. In the rough rolling step, the starting material is subjected to hot working to be produced into a billet. In the rough rolling step, for example, a blooming mill is used. The blooming mill is used to perform blooming on the starting material, producing the billet. In a case where a continuous mill is arranged downstream of the blooming mill, the billet produced by the blooming may be further subjected to hot rolling with the continuous mill to be produced into a billet having a smaller size. In the continuous mill, for example, horizontal stands each including a pair of horizontal rolls and vertical stands each including a pair of vertical rolls are arranged alternately in a row. A temperature of the starting material immediately before the rough rolling step is not limited to a particular temperature but is, for example, 900 to 1300° C. In the finish rolling step, the billet is first heated. The heated billet is subjected to hot rolling with a continuous mill to be produced into a bar material. A heating temperature in a reheating furnace in the finish rolling step is not limited to a particular temperature but is, for example, 800 to 1300° C.

[Cold Working Step]

The cold working step is performed when necessary. That is, the cold working step is an optional step and need not be performed. In a case where the cold working step is performed, the intermediate material is subjected to descaling treatment and thereafter subjected to cold working. The descaling treatment is, for example, shotblast and/or pickling. In a case where the intermediate material is a tube material or a bar material, the cold working is, for example, cold drawing or cold Pilger rolling. In a case where the intermediate material is a sheet material, the cold working is, for example, cold rolling. By performing the cold working step, a strain is applied to the intermediate material before the heat treatment step. This enables recrystallization to occur and regulation of sizes of the recrystallized grains in the heat treatment step. A reduction of area in the cold working step is not limited to a particular reduction of area but is, for example, 10 to 70%.

[Heat Treatment Step]

The heat treatment step is performed when necessary. That is, the heat treatment step is an optional step and need not be performed. In a case where the heat treatment step is performed, the intermediate material subjected to the hot working step or the cold working step is subjected to heat treatment for recrystallization. A heat treatment temperature is 750 to 950° C. A retention duration at the heat treatment temperature is not limited to a particular duration but is, for example, 5 to 30 minutes. The intermediate material after a lapse of the retention duration is subjected to water cooling to be produced into the alloy as a product.

Through the producing steps described above, the alloy according to the present embodiment can be produced. Note that the producing method for the alloy is not limited to a particular producing method as long as the chemical composition according to the present embodiment is satisfied.

EXAMPLE

The advantageous effects of the alloy according to the present embodiment will be described below more specifically with reference to EXAMPLE. Conditions described in EXAMPLE described below are an example of conditions that are adapted to confirm the feasibility and the advantageous effects of the alloy according to the present embodiment. Therefore, the alloy according to the present embodiment is not limited to this example of conditions.

Molten alloys of test numbers in Table 1 were produced by vacuum melting, and the molten alloys were used to produce column-shaped ingots having chemical compositions shown in Table 1. An outer diameter of the ingots was 250 mm.

TABLE 1

| Test | Chemical composition (in mass %, the balance: Fe and impurities) | | | | | | | | | | | | |
|---|---|---|---|---|---|---|---|---|---|---|---|---|---|
| No. | C | Si | Mn | P | S | Ni | Cr | Mo | Co | Al | Ca | Mg | N |
| 1 | 0.03 | 0.15 | 0.21 | 0.005 | 0.0012 | 35.5 | 0.02 | 0.01 | 0.023 | 0.0002 | 0.0003 | 0.0003 | 0.0012 |
| 2 | 0.08 | 0.14 | 0.22 | 0.005 | 0.0015 | 35.7 | 0.03 | 0.02 | 0.020 | 0.0003 | 0.0002 | 0.0003 | 0.0009 |
| 3 | 0.02 | 0.26 | 0.25 | 0.004 | 0.0015 | 36.3 | 0.02 | 0.01 | 0.018 | 0.0002 | 0.0005 | 0.0005 | 0.0012 |
| 4 | 0.03 | 0.15 | 0.25 | 0.005 | 0.0012 | 36.1 | 0.02 | 0.03 | 0.021 | 0.0026 | 0.0002 | 0.0004 | 0.0010 |
| 5 | 0.03 | 0.12 | 0.43 | 0.006 | 0.0005 | 35.8 | 0.01 | 0.02 | 0.008 | 0.0002 | 0.0005 | 0.0008 | 0.0008 |
| 6 | 0.04 | 0.14 | 0.35 | 0.005 | 0.0006 | 36.8 | 0.02 | 0.01 | 0.009 | 0.0021 | 0.0011 | 0.0006 | 0.0045 |
| 7 | 0.03 | 0.14 | 0.16 | 0.002 | 0.0013 | 34.5 | 0.10 | 0.01 | 0.011 | 0.0020 | 0.0008 | 0.0003 | 0.0058 |
| 8 | 0.03 | 0.15 | 0.24 | 0.005 | 0.0008 | 35.6 | 0.01 | 0.01 | 0.020 | 0.0002 | 0.0024 | 0.0018 | 0.0006 |
| 9 | 0.04 | 0.20 | 0.24 | 0.006 | 0.0012 | 36.1 | 0.03 | 0.01 | 0.024 | 0.0008 | 0.0013 | 0.0008 | 0.0011 |
| 10 | 0.04 | 0.22 | 0.23 | 0.011 | 0.0010 | 36.0 | 0.02 | 0.01 | 0.008 | 0.0012 | 0.0005 | 0.0022 | 0.0007 |
| 11 | 0.03 | 0.25 | 0.33 | 0.005 | 0.0008 | 35.8 | 0.02 | 0.01 | 0.009 | 0.0020 | 0.0005 | 0.0003 | 0.0041 |
| 12 | 0.04 | 0.14 | 0.32 | 0.006 | 0.0009 | 35.9 | 0.04 | 0.01 | 0.009 | 0.0002 | 0.0004 | 0.0002 | 0.0008 |
| 13 | 0.05 | 0.23 | 0.28 | 0.005 | 0.0005 | 36.7 | 0.01 | 0.03 | 0.014 | 0.0021 | 0.0008 | 0.0006 | 0.0013 |
| 14 | 0.06 | 0.22 | 0.29 | 0.004 | 0.0006 | 35.9 | 0.02 | 0.01 | 0.009 | 0.0009 | 0.0002 | 0.0008 | 0.0011 |
| 15 | 0.05 | 0.20 | 0.34 | 0.008 | 0.0008 | 35.6 | 0.02 | 0.01 | 0.008 | 0.0031 | 0.0003 | 0.0007 | 0.0008 |
| 16 | 0.03 | 0.16 | 0.35 | 0.005 | 0.0009 | 36.0 | 0.02 | 0.02 | 0.011 | 0.0003 | 0.0005 | 0.0012 | 0.0026 |
| 17 | 0.03 | 0.14 | 0.19 | 0.005 | 0.0012 | 36.0 | 0.01 | 0.01 | 0.020 | 0.0001 | 0.0008 | 0.0021 | 0.0032 |
| 18 | 0.03 | 0.16 | 0.22 | 0.006 | 0.0011 | 36.3 | 0.03 | 0.03 | 0.016 | 0.0022 | 0.0015 | 0.0001 | 0.0009 |
| 19 | 0.05 | 0.23 | 0.23 | 0.005 | 0.0009 | 35.6 | 0.01 | 0.01 | 0.015 | 0.0021 | 0.0001 | 0.0013 | 0.0006 |
| 20 | 0.07 | 0.13 | 0.25 | 0.012 | 0.0014 | 36.3 | 0.07 | 0.01 | 0.100 | 0.0014 | 0.0004 | 0.0007 | 0.0005 |
| 21 | 0.03 | 0.15 | 0.25 | 0.007 | 0.0010 | 36.1 | 0.01 | 0.02 | 0.020 | 0.0008 | 0.0006 | 0.0003 | 0.0030 |

TABLE 1-continued

| | | | | | | | | | | | | | |
|---|---|---|---|---|---|---|---|---|---|---|---|---|---|
| 22 | 0.03 | 0.15 | 0.33 | 0.007 | 0.0009 | 36.5 | 0.02 | 0.02 | 0.006 | 0.0001 | 0.0020 | 0.0004 | 0.0150 |
| 23 | 0.03 | 0.22 | 0.19 | 0.005 | 0.0006 | 36.0 | 0.02 | 0.01 | 0.020 | 0.0002 | 0.0011 | 0.0003 | 0.0016 |
| 24 | 0.03 | 0.41 | 0.25 | 0.008 | 0.0006 | 35.8 | 0.01 | 0.01 | 0.014 | 0.0026 | 0.0020 | 0.0006 | 0.0030 |
| 25 | 0.04 | 0.10 | 0.26 | 0.004 | 0.0009 | 36.2 | 0.03 | 0.01 | 0.022 | 0.0019 | 0.0007 | 0.0011 | 0.0003 |
| 26 | 0.04 | 0.15 | 0.32 | 0.013 | 0.0004 | 36.3 | 0.01 | 0.01 | 0.021 | 0.0015 | 0.0025 | 0.0003 | 0.0001 |
| 27 | 0.03 | 0.17 | 0.32 | 0.015 | 0.0008 | 36.3 | 0.02 | 0.02 | 0.017 | 0.0033 | 0.0031 | 0.0006 | 0.0061 |
| 28 | 0.03 | 0.18 | 0.31 | 0.013 | 0.0008 | 36.2 | 0.02 | 0.02 | 0.015 | 0.0061 | 0.0024 | 0.0002 | 0.0035 |
| 29 | 0.02 | 0.17 | 0.32 | 0.015 | 0.0011 | 36.1 | 0.01 | 0.03 | 0.015 | 0.0042 | 0.0018 | 0.0002 | 0.0011 |
| 30 | 0.08 | 0.15 | 0.28 | 0.010 | 0.0017 | 37.4 | 0.11 | 0.03 | 0.009 | 0.0013 | 0.0045 | 0.0001 | 0.0097 |

| | Chemical composition (in mass %, the balance: Fe and impurities) | | | | | | | | | | | |
|---|---|---|---|---|---|---|---|---|---|---|---|---|
| Test No. | O | Pb | Zn | Nb | Ti | V | Nb + Ti + V | Cu | Sn | W | Cu + Sn + W | B |
| 1 | 0.0118 | 0.0001 | 0.001 | 0.042 | | | 0.042 | 0.031 | | 0.015 | 0.046 | 0.0001 |
| 2 | 0.0070 | 0.0001 | 0.001 | | 0.053 | | 0.053 | 0.093 | | 0.010 | 0.103 | 0.0001 |
| 3 | 0.0021 | 0.0002 | 0.001 | | | 0.048 | 0.048 | 0.002 | | 0.005 | 0.007 | 0.0001 |
| 4 | 0.0070 | 0.0001 | 0.001 | 0.018 | | | 0.018 | 0.031 | 0.005 | 0.020 | 0.056 | 0.0003 |
| 5 | 0.0057 | 0.0001 | 0.002 | 0.021 | | 0.019 | 0.040 | 0.028 | 0.010 | 0.008 | 0.046 | 0.0001 |
| 6 | 0.0174 | 0.0001 | 0.001 | 0.005 | | 0.018 | 0.023 | | | | | |
| 7 | 0.0050 | 0.0001 | 0.001 | | 0.023 | 0.111 | 0.134 | | | | | |
| 8 | 0.0141 | 0.0002 | 0.002 | | 0.025 | | 0.025 | 0.011 | 0.004 | 0.010 | 0.025 | |
| 9 | 0.0069 | 0.0001 | 0.001 | 0.034 | | 0.006 | 0.040 | 0.033 | 0.003 | 0.005 | 0.041 | |
| 10 | 0.0061 | 0.0001 | 0.001 | | 0.018 | | 0.018 | | | | | 0.0015 |
| 11 | 0.0124 | 0.0002 | 0.001 | 0.085 | | 0.019 | 0.104 | | | | | 0.0028 |
| 12 | 0.0015 | 0.0001 | 0.001 | | | | 0.000 | | | | | 0.0001 |
| 13 | 0.0022 | 0.0001 | 0.001 | 0.384 | | | 0.384 | | | | | |
| 14 | 0.0072 | 0.0001 | 0.002 | | 0.352 | | 0.352 | | | | | |
| 15 | 0.0054 | 0.0001 | 0.001 | | | 0.397 | 0.397 | | | | | |
| 16 | 0.0010 | 0.0002 | 0.002 | | | 0.005 | 0.005 | | | | | |
| 17 | 0.0096 | 0.0001 | 0.001 | | 0.005 | 0.003 | 0.008 | | | | | |
| 18 | 0.0056 | 0.0001 | 0.001 | 0.002 | 0.002 | 0.002 | 0.006 | | | | | |
| 19 | 0.0089 | 0.0001 | 0.001 | | | 0.398 | 0.398 | 0.005 | | 0.010 | 0.015 | 0.0001 |
| 20 | 0.0070 | 0.0002 | 0.001 | 0.321 | | | 0.321 | | 0.002 | 0.008 | 0.010 | 0.0001 |
| 21 | 0.0055 | 0.0001 | 0.001 | | | | 0.000 | 0.020 | 0.204 | 0.010 | 0.234 | 0.0001 |
| 22 | 0.0054 | 0.0001 | 0.001 | | 0.396 | | 0.396 | 0.186 | | 0.010 | 0.196 | 0.0002 |
| 23 | 0.0098 | 0.0046 | 0.001 | 0.097 | | 0.188 | 0.285 | 0.005 | 0.003 | | 0.008 | 0.0001 |
| 24 | 0.0023 | 0.0001 | 0.002 | 0.120 | 0.092 | | 0.212 | 0.008 | | 0.010 | 0.018 | 0.0053 |
| 25 | 0.0035 | 0.0003 | 0.001 | 0.291 | | | 0.291 | 0.520 | | | 0.520 | |
| 26 | 0.0073 | 0.0001 | 0.001 | | 0.168 | 0.142 | 0.310 | | | 0.656 | 0.656 | |
| 27 | 0.0013 | 0.0001 | 0.001 | 0.234 | 0.148 | 0.097 | 0.479 | | | | | |
| 28 | 0.0013 | 0.0001 | 0.001 | 0.039 | 0.084 | 0.021 | 0.144 | | 0.002 | | 0.002 | 0.0022 |
| 29 | 0.0013 | 0.0001 | 0.001 | 0.021 | 0.089 | | 0.110 | 0.250 | | 0.021 | 0.271 | 0.0015 |
| 30 | 0.0012 | 0.0001 | 0.001 | | 0.140 | 0.021 | 0.161 | 0.014 | 0.002 | 0.005 | 0.021 | 0.0007 |

Blank fields seen in Table 1 each mean that a content of a corresponding element was less than a detection limit of the element. That is, the blank fields each indicate that a content of a corresponding element fell below a detection limit of the element at its least significant digit. For example, in a case of contents of Ti shown in Table 1, their least significant digit is the third decimal place. Therefore, a content of Ti of Test No. 1 means that Ti was not detected to the third decimal place (the content of Ti was 0% through significant figures up to the third decimal place).

The ingots were each heated to 1200° C. The heated ingot was subjected to the hot forging to be produced into a starting material that was 40 mm thick and 100 mm wide. The starting material was subjected to the hot rolling to be produced into an intermediate material (alloy sheet). A heating temperature of the starting material in the hot rolling was 1200° C. The intermediate material was subjected to the cold rolling to be produced into an intermediate material (alloy sheet) that was 15 mm thick and 100 mm wide. The intermediate material subjected to the cold rolling was subjected to the heat treatment at a heat treatment temperature of 850° C. The retention duration at the heat treatment temperature was 30 minutes. After a lapse of the retention duration, the intermediate material was subjected to the water cooling to be produced into an alloy (alloy sheet) of each test number. Note that the reduction of area in the hot rolling and the reduction of area in the cold rolling were each common to all test numbers.

[Evaluation Test]

[Gleeble Test]

Hot workability of an alloy of each test number was evaluated by the Gleeble test. From the ingot of each test number subjected to the hot forging, a bar specimen having an outer diameter of 10 mm and a length of 130 mm was extracted, and its reduction of area at 900° C. was determined. Specifically, the bar specimen was placed on a Gleeble machine (Gleeble 3500-GTC from DYNAMIC SYSTEM Inc.). The bar specimen was heated to 1200° C. by direct resistance heating and retained for 1 minute. Thereafter, a temperature of the bar specimen was decreased to 900° C. in 1 minute, pulled out to be ruptured at a distortion velocity of 10/sec, and a reduction of area (a rupture area of the bar specimen after the test/an area of a cross-sectional of the bar specimen perpendicular to a longitudinal direction before the test) was calculated. Reductions of area (%) at 900° C. of intermediate materials of the test numbers are shown in Table 2. When a reduction of area at 900° C. of a test number was less than 70%, the test number was determined to be poor in hot workability. For an intermediate material of a test number determined to be poor in hot workability, the hot working step and the subsequent steps were not performed, and evaluation tests described below (a thermal expansion coefficient evaluation test, a tensile strength evaluation test, and a corrosion resistance evaluation test) were not conducted (shown as "-" in the "Coefficient of linear expansion" column, the "Tensile strength" column, and the "Corrosion rate" column in Table 2).

TABLE 2

| Test No. | Fn1 | Reduction of area (%) | Coefficient of linear expansion ($\times 10^{-6}$/K) | Tensile strength (MPa) | Corrosion rate |
|---|---|---|---|---|---|
| 1 | 1.35 | 87 | 0.95 | 537 | A |
| 2 | 1.97 | 88 | 0.98 | 527 | A |
| 3 | 2.26 | 89 | 0.96 | 522 | B |
| 4 | 0.58 | 90 | 0.92 | 496 | A |
| 5 | 1.30 | 89 | 0.96 | 513 | A |
| 6 | 0.52 | 91 | 0.95 | 478 | B |
| 7 | 5.03 | 86 | 1.00 | 543 | B |
| 8 | 2.45 | 91 | 0.97 | 485 | A |
| 9 | 0.97 | 88 | 0.97 | 524 | A |
| 10 | 1.33 | 90 | 1.00 | 479 | B |
| 11 | 3.05 | 84 | 0.99 | 548 | B |
| 12 | 0.00 | 92 | 1.00 | 458 | B |
| 13 | 7.49 | 78 | 6.50 | 645 | X |
| 14 | 17.28 | 79 | 12.61 | 631 | X |
| 15 | 7.81 | 80 | 7.05 | 628 | X |
| 16 | 0.15 | 92 | 1.00 | 456 | B |
| 17 | 0.54 | 91 | 1.00 | 458 | B |
| 18 | 0.32 | 92 | 1.00 | 464 | B |
| 19 | 7.87 | 81 | 12.53 | 633 | X |
| 20 | 4.55 | 80 | 2.17 | 657 | X |
| 21 | 0.00 | 58 | — | — | — |
| 22 | 26.40 | 75 | 27.21 | 642 | X |
| 23 | 9.02 | 56 | — | — | — |
| 24 | 12.00 | 52 | — | — | — |
| 25 | 7.22 | 49 | — | — | — |
| 26 | 16.11 | 56 | — | — | — |
| 27 | 21.47 | 74 | 31.06 | 669 | X |
| 28 | 9.31 | 86 | 11.86 | 627 | X |
| 29 | 13.65 | 82 | 19.53 | 634 | B |
| 30 | 4.92 | 84 | 2.88 | 645 | X |

[Thermal Expansion Coefficient Evaluation Test]

A test specimen having a diameter of 5 mm and a length of 20 mm was extracted from an alloy sheet of each test number at its sheet-width center position and its sheet-thickness center position. A longitudinal direction of the test specimen was parallel to a longitudinal direction of the alloy sheet. A central axis of the test specimen substantially coincided with the sheet-thickness center position of the alloy sheet. The test specimen was used, and its thermal expansion coefficient was determined based on JIS Z 2285 (2003). For measurement of the thermal expansion coefficient, a horizontal differential dilatometer (DIL402 Expedis Supreme from NETZSCH) was used. Specifically, a temperature of the test specimen was increased at a rate of 5° C./min, and thermal expansion coefficients at 30 to 100° C. were determined with a pitch of 1° C. A mean of the determined thermal expansion coefficients was determined to be a coefficient of linear expansion ($\times 10^{-6}$/K). Coefficients of linear expansion ($\times 10^{-6}$/K) of the alloys of test numbers are shown in Table 2.

[Tensile Strength Evaluation Test]

A test specimen was extracted from an alloy of each test number at its sheet-width center position and its sheet-thickness center position. The test specimen was a tensile test specimen including a parallel portion that had a length of 65 mm and a diameter of 6 mm. The length of the parallel portion was parallel to the longitudinal direction of the alloy. A central axis of the tensile test specimen substantially coincided with the sheet-thickness center position of the alloy sheet. Using the tensile test specimen, the tensile test was conducted in the atmosphere at a normal temperature, in conformity with JIS Z 2241(2011), thereby determining its tensile strength (MPa). Tensile strengths (MPa) of the alloy of test numbers are shown in Table 2.

[Corrosion Resistance Evaluation Test]

A test specimen having a thickness of 1 mm, a width of 10 mm, and a length of 55 mm was extracted from an alloy of each test number at its sheet-width center position and its sheet-thickness center position. A longitudinal direction of the test specimen was parallel to a longitudinal direction of the alloy sheet. A center position of a cross section of the test specimen perpendicular to the longitudinal direction of the test specimen substantially coincided with the sheet-thickness center position of the alloy sheet. Using the test specimen, a ferric chloride corrosion test was conducted in conformity with JIS G 0578(2000). Specifically, the test specimen was subjected to surface polishing. The test specimen subjected to the surface polishing was degreased and thereafter dried. A mass of the test specimen before the test was measured. After the mass was measured, the test specimen was immersed into a 6% ferric chloride solution. During the immersion, a temperature of the solution was set at 35 ±1° C. After the test specimen was immersed for 24 hours, the test specimen was taken out from the solution. After corrosion products adhering to the test specimen were removed, the test specimen was cleaned and dried. The mass of the test specimen after the drying was measured, and a reduction in the mass was determined. Based on the determined reduction in the mass, a corrosion rate (mg/cm$^2$/h)) was determined. Based on the determined corrosion rate, a corrosion resistance of an alloy of each test number was evaluated as follows.

Evaluation A: the corrosion rate was 0.90 times or less a corrosion rate of a reference material Evaluation B: the corrosion rate was more than 0.90 times to 1.00 the corrosion rate of the reference material Evaluation X. the corrosion rate was more than 1.00 the corrosion rate of the reference material In a case of Evaluation A, it was determined that a particularly excellent corrosion resistance was obtained. Obtained results of the evaluation are shown in the "Corrosion rate" column in Table 2. Note that a corrosion rate of a test number 12 (reference material) was 6.5 mg/cm$^2$/h.

[Results of Evaluation]

Referring to Table 1 and Table 2, the chemical compositions of alloys of Test Nos. 1 to 11 were appropriate, and their total contents of Nb, Ti, and V were 0.015 to less than 0.145%, and the chemical compositions satisfied Formula (1). As a result, tensile strengths of the alloy of Test Nos. 1 to 11 were 472 MPa or more. In addition, thermal expansion coefficients of the alloy of Test Nos. Ito 11 were 1.00× $10^{-6}$/K or less. Note that reductions of area at 900° C. of the alloy of Test Nos. 1 to 11 were 70% or more.

In addition, of Test Nos. 1 to 11, in test Nos. 1 to 3, 5, 7, 9, and 11, their total contents of Nb, Ti, and V were 0.030% or more. As a result, their tensile strengths were 504 MPa or more, and more excellent strengths were obtained as compared with Test Nos. 4, 6, 8, and 10, in which their total contents of Nb, Ti, and V were less than 0.030%.

In addition, of Test Nos. 1 to 11, in test Nos. 1, 2, 4, 5, 8, and 9, their total contents of Cu, Sn, and W were 0.020% or more. As a result, not only high strengths and low thermal expansion coefficients but also excellent corrosion resistances were obtained because their corrosion resistances were rated as Evaluation A (corrosion rates of 5.9 mg/cm$^2$/h or less).

In contrast, in Test No. 12, its total content of Nb, Ti, and V was less than 0.015%. As a result, its strength was excessively low.

In Test No. 13, its content of Nb was excessively high. Therefore, its total content of Nb, Ti, and V was more than 0.145%. As a result, its thermal expansion coefficient was excessively high. In addition, its corrosion resistance was low.

In Test No. 14, its content of Ti was excessively high. Therefore, its total content of Nb, Ti, and V was more than 0.145%. As a result, its thermal expansion coefficient was excessively high. In addition, its corrosion resistance was low.

In Test No. 15, its content of V was excessively high. Therefore, its total content of Nb, Ti, and V was more than 0.145%. As a result, its thermal expansion coefficient was excessively high. In addition, its corrosion resistance was low.

In Test Nos. 16 to 18, their total contents of Nb, Ti, and V were less than 0.015%. As a result, their strengths were excessively low.

In Test No. 19, its content of V was excessively high. Therefore, its total content of Nb, Ti, and V was more than 0.145%. As a result, its thermal expansion coefficient was excessively high. In addition, its corrosion resistance was low.

In Test No. 20, its content of Nb was excessively high. Therefore, its total content of Nb, Ti, and V was more than 0.145%. As a result, its thermal expansion coefficient was excessively high. In addition, its corrosion resistance was low.

In Test No. 21, its content of Sn was excessively high. As a result, a crack was recognized in its intermediate material after the hot rolling, and its hot workability was low.

In Test No. 22, its content of Ti was high, and its total content of Nb, Ti and V was more than 0.145%. Moreover, its content of N was excessively high. As a result, its thermal expansion coefficient was excessively high. In addition, its corrosion resistance was low.

In Test No. 23, its content of Pb was excessively high. As a result, a crack was recognized in its intermediate material after the hot rolling, and its hot workability was low.

In Test No. 24, its content of B was excessively high. As a result, a crack was recognized in its intermediate material after the hot rolling, and its hot workability was low.

In Test No. 25, its content of Cu was excessively high. As a result, a crack was recognized in its intermediate material after the hot rolling, and its hot workability was low.

In Test No. 26, its content of W was excessively high. As a result, a crack was recognized in its intermediate material after the hot rolling, and its hot workability was low.

In Test No. 27, its content of Nb and its content of Ti were excessively high. Therefore, its total content of Nb, Ti, and V was more than 0.145%. As a result, its thermal expansion coefficient was excessively high. In addition, its corrosion resistance was low.

In Test No. 28, although its contents of elements and its total content of Nb, Ti, and V were appropriate, Formula (1) was not satisfied. As a result, its thermal expansion coefficient was excessively high. In addition, its corrosion resistance was low.

In Test No. 29, although its contents of elements and its total content of Nb, Ti, and V were appropriate, Formula (1) was not satisfied. As a result, its thermal expansion coefficient was excessively high.

In Test No. 30, its total content of Nb, Ti, and V was 0.145% or more. As a result, its thermal expansion coefficient was excessively high. In addition, its corrosion resistance was low.

An embodiment of the present invention has been described above. However, the embodiment described above is merely exemplification for carrying out the present invention. The present invention is therefore not limited to the embodiment described above, and the embodiment described above can be modified and practiced as appropriate without departing from the scope of the present invention.

The invention claimed is:

1. An alloy having a chemical composition consisting of: in mass %,

C: 0.02 to 0.10%,
Si: 0.50% or less,
Mn: 0.15 to 0.60%,
P: 0.015% or less,
S: 0.0030% or less,
Ni: 30.0 to 40.0%,
Cr: 0.50% or less,
Mo: 0.50% or less,
Co: 0.250% or less,
Al: 0.0150% or less,
Ca: 0.0050% or less,
Mg: 0.0300% or less,
N: 0.0100% or less,
O: 0.0300% or less,
Pb: 0.0040% or less,
Zn: 0.020% or less,
a total of one or more elements selected from the group consisting of Nb: 0 to less than 0.145%, Ti: 0 to less than 0.145%, and V: 0 to less than 0.145%: 0.015 to less than 0.145%,
Cu: 0 to 0.300%,
Sn: 0 to 0.100%,
W: 0 to 0.200%, and
B: 0 to 0.0040%,
with the balance being Fe and impurities, and satisfying Formula (1):

$$(Nb+3\times Ti+V)/(C+N)\leq 5.20 \quad (1)$$

where symbols of elements in Formula (1) are to be substituted by contents of the elements in the chemical composition of the alloy, in mass %.

2. The alloy according to claim 1, wherein the chemical composition contains one or more elements selected from the group consisting of Cu: 0 to 0.300%, Sn: 0 to 0.100%, and W: 0 to 0.200% at 0.020% or more in total.

3. The alloy according to claim 2, the alloy is any one of a tube material, a sheet material, and a bar material.

4. The alloy according to claim 1, the alloy is any one of a tube material, a sheet material, and a bar material.

* * * * *